United States Patent [19]

Chern

[11] Patent Number: 4,815,881

[45] Date of Patent: Mar. 28, 1989

[54] MULTI-PURPOSE COMBINATION WRITING INSTRUMENT

[76] Inventor: Biing-Hwang Chern, 4th Floor, No. 10, Alley 10, Lane 44, Sec. 2 Hsing Yi Road, Taipei, Taiwan

[21] Appl. No.: 125,452

[22] Filed: Nov. 25, 1987

[51] Int. Cl.[4] ..... B43K 29/00; B43K 29/08

[52] U.S. Cl. ..... 401/52; 401/195; 33/27.82; 33/558.01; 33/558.3

[58] Field of Search ..... 401/195, 52; 33/149 R, 33/149 D, 149 H, 152, 153 R

[56] References Cited

U.S. PATENT DOCUMENTS

| | | | |
|---|---|---|---|
| 752,699 | 2/1904 | Neukirchen | 33/149 R |
| 1,611,835 | 12/1926 | Keaney | 401/52 X |
| 1,674,726 | 6/1928 | Keaney | 401/52 X |
| 2,505,437 | 4/1950 | Skolinick | 33/152 B |

FOREIGN PATENT DOCUMENTS

| | | | |
|---|---|---|---|
| 1291651 | 3/1969 | Fed. Rep. of Germany | 401/52 |
| 933328 | 4/1948 | France | 401/195 |
| 701627 | 3/1966 | Italy | 401/52 |
| 23221 | 10/1930 | Netherlands | 401/52 |
| 2180505 | 4/1987 | United Kingdom | 401/195 |

*Primary Examiner*—Steven A. Bratlie

*Attorney, Agent, or Firm*—Browdy and Neimark

[57] ABSTRACT

A multi-purpose combination writing instrument which has an elongated core member with a hexagon cross section received in a correspondingly shaped pen tube consisting of a right and left members which can be converted into a compass after removing the core member with the right and left members pivotably opened to any angle from 0 to 180 degrees and further into an elongated straight ruler when the pen tube is widely opened with the right and left members arranged in rectilinear manner, in the meanwhile the core member can be independently used as a writing tool to mark lines. An eraser as well as a needle mount is received inside a cap, the needle mount is adapted as a pivot point when the writing instrument is used as a compass.

9 Claims, 5 Drawing Sheets

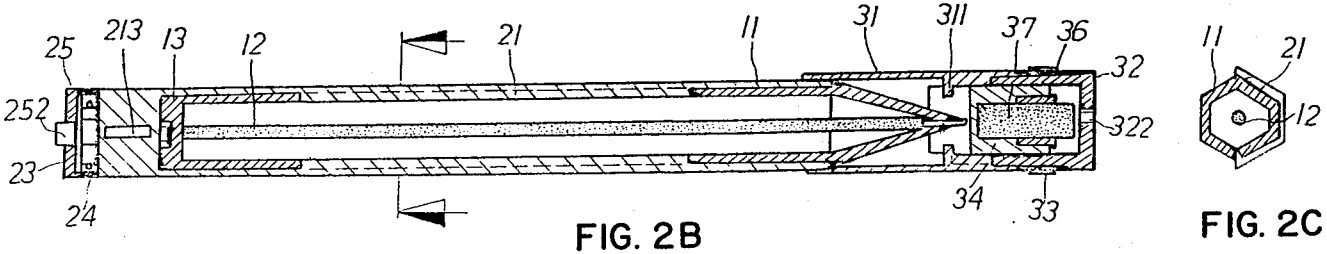
FIG. 2C
FIG. 2B
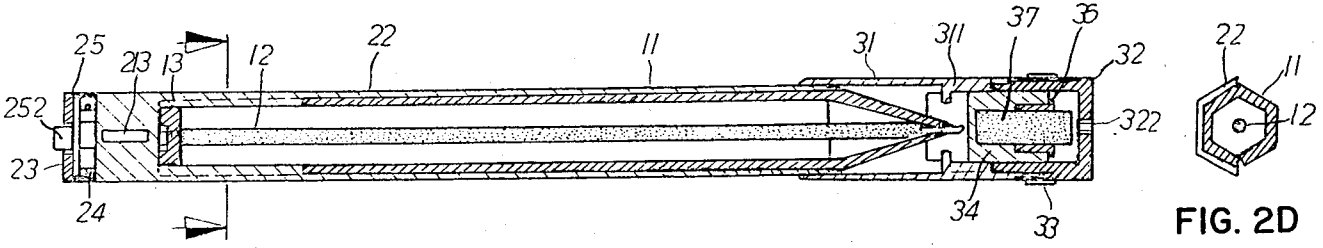
FIG. 2D
FIG. 2A

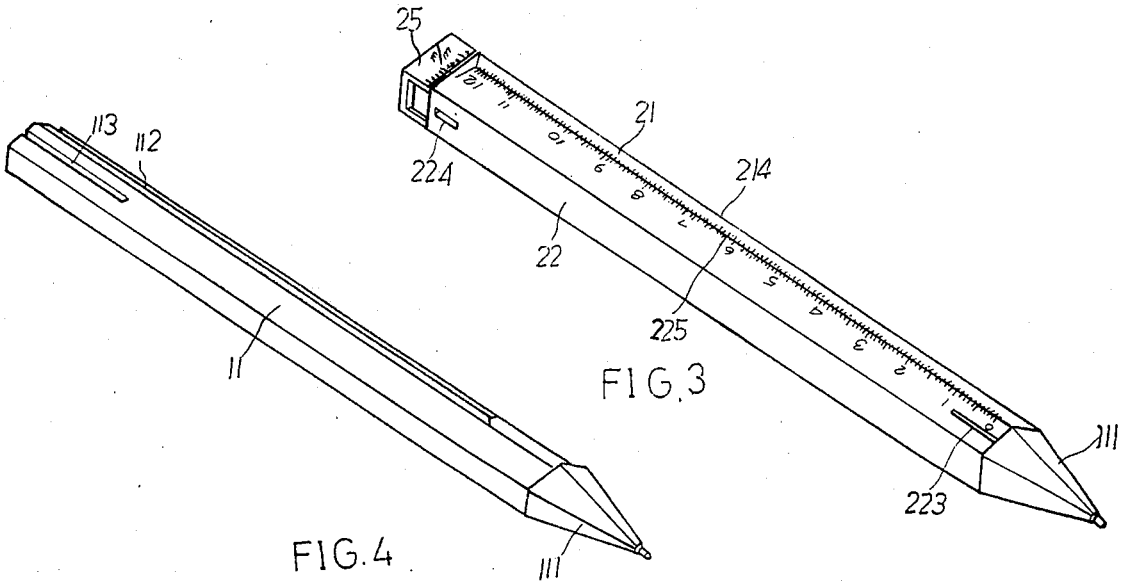
FIG. 3
FIG. 4
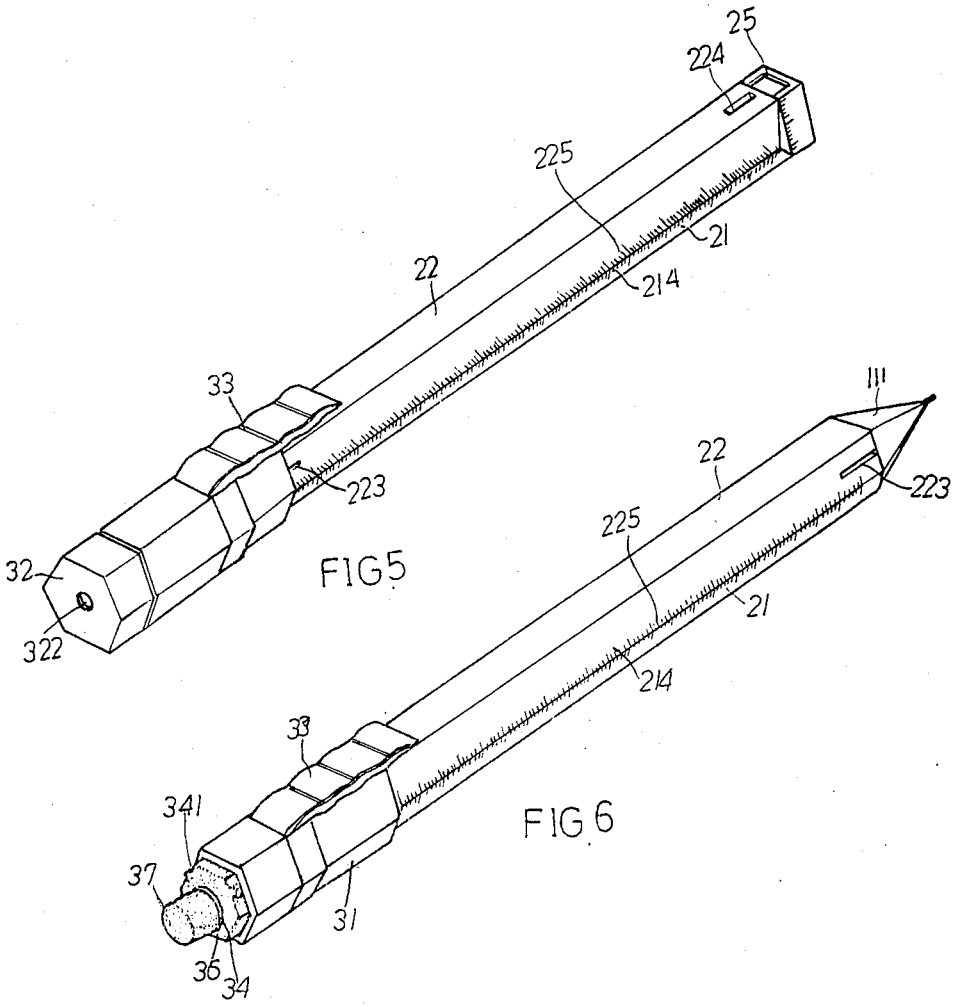
FIG5
FIG 6

MULTI-PURPOSE COMBINATION WRITING INSTRUMENT

BACKGROUND OF THE INVENTION

1. Field of the Invention

The present invention relates to a convertible writing instrument which can be transformed into a straight ruler, a compass, a writing instrument with an eraser, serving as a complete stationery box. The present combinational writing instrument is characterized in its writing core member having a hexagon cross section which is removably housed in a two-piece tube which consists of right and left members pivotably hinged together so that the present writing instrument can be converted to a compass with its open angle freely adjusted within the range of 0–180 degrees, and further to an elongated straight ruler with the right and left members arranged in a rectilinear manner, the ruler is marked with both centimeter and inch units for the facility of use. An eraser is also attached at the end of the writing instrument.

2. The Prior Art

It is often encountered by people to use a pen or the like to mark straight lines or circles without a proper ruler and compass at hand when dealing with daily business. To use a name card or a book and coins of different size to mark straight lines and circles can roughly solve the problem but in a limited manner. Furthermore, the measurement of a certain length is not able to be performed as a result of lack of precise instrument.

SUMMARY OF THE INVENTION

Therefore, the primary object of the present invention is to provide a multi-purpose combination writing instrument with a removable core member which can be freely replaced as desired for choice of different colors.

The other object of the present invention is to provide a multi-purpose combination writing instrument which has pivotally openable tube consisting of a right and left member, inside; of which said writing core member can be received, and the right and left members can be adjustably separated for use as the two legs of a compass with the help of a needle mount.

One further object of the present invention is to provide a multi-purpose combination writing instrument which can be used as a straight ruler when the right and left tube members are widely seperated and arranged in rectilinear manner, on the outer surface of the right and left members are marked with centimeter and inch units for the facility of measurement.

One still further object of the present invention is to provide a multi-purpose combination writing instrument which is provided with an eraser disposed at the end of the tube and covered by a cap.

BRIEF DESCRIPTION OF THE INVENTION

To make the present invention more clear of its operation mode and structure, a number of drawings are illustrated along with a detailed description of the preferred embodiment, in which:

FIG. 1 is an exploded view of the present multi-purpose combination writing instrument;

FIG. 2*a* and 2*b* are elevational sectional views of the present invention, while 2*d* and 2*c* are respective cross-sections;

FIG. 3 is a diagram showing the perspective structure of the present invention;

FIG. 4 is a diagram showing the core member of the present invention;

FIG. 5 is a diagram showing the present writing instrument being attached with a cap;

FIG. 6 is a diagram showing the location of an eraser;

DETAILED DESCRIPTION OF THE PREFERRED EMBODIMENT

Figure 1:
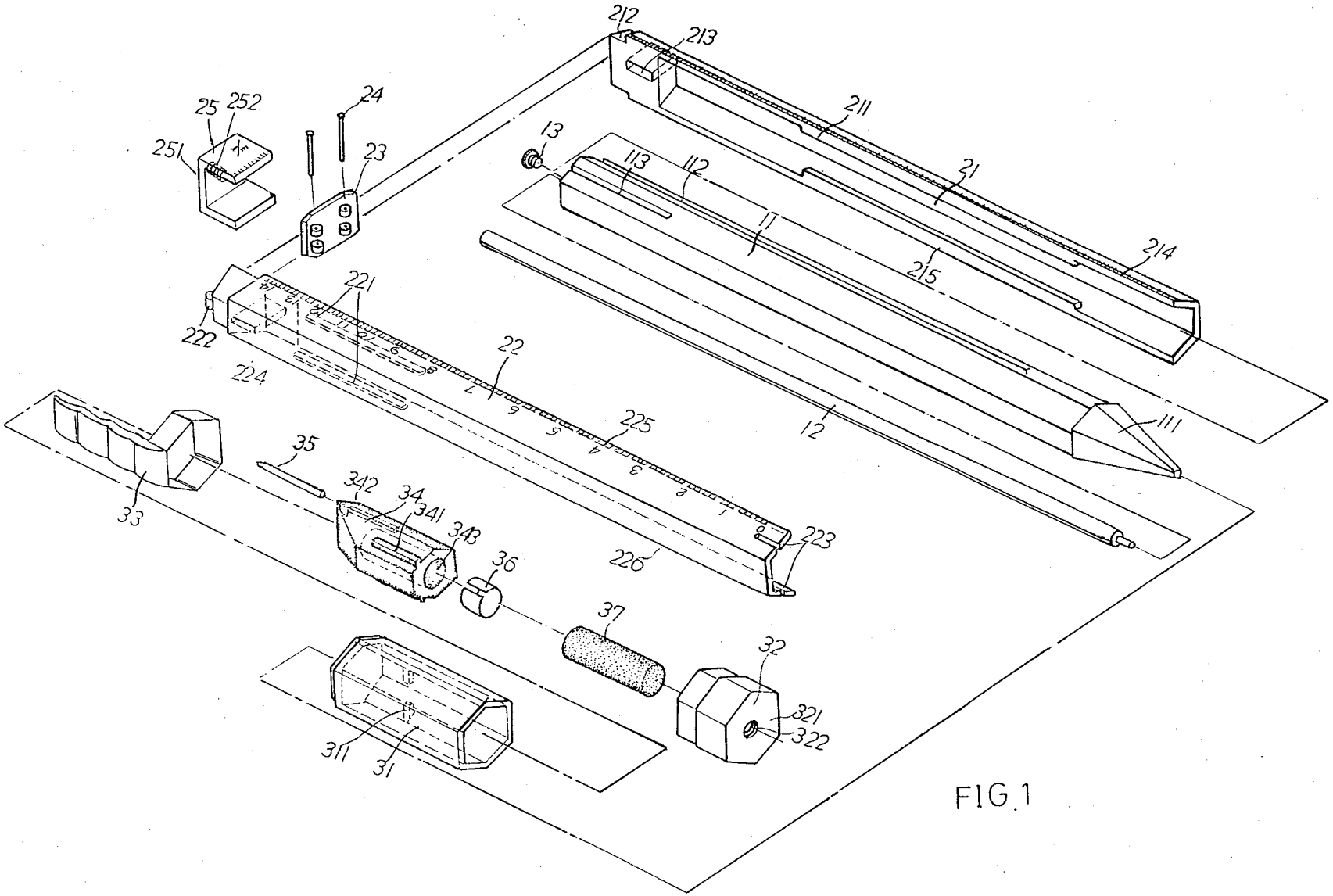

As shown in FIG. 1, the present multi-purpose writing instrument consists of an elongated core member 11 having a cross section in hexagonal configuration and a cone-shaped, six-facet head portion 111. A ball-pen tube 12 is inserted into said core member 11 and locked in place by a threaded lid component 13 screwed to the core member 11. On the outer surface of said hexagon-shaped core member 11, there are disposed a pair of long flutes 112 and two relatively short flutes 113. Correspondingly, a pair of elongated protrusions 211, 215 are disposed along the upper and lower edges of a right tube member 21 which is separably pivotably hinged to a symmetrically-shaped left tube member 22, said right and left tube members being pivotably joined at one end so that said core member 11, with said ball-pen tube 12 inserted therein, can be removably housed therein in use.

In assembly, said elongated flutes 112 are engaged with said correspondingly located protrusions 211, 215 respectively with said short flutes 113 being in registry with a pair of correspondingly planted projections 221 on the upper and lower inner sides of said left tube member 22.

Said cone-shaped six-facet head portion 111 is designed in such a manner that the joint between the hexagonal core member 11 and the head portion 111 has a peripherally-disposed shoulder, thus the right and left tube members 21, 22 can be assembled to the core member 11 and to said head portion 111 in a fitted manner.

At each end of said right and left tube members is disposed a pin hole 212, 222 for the attachment of a rectangular block 23. Block 23 includes with four symmetrically arranged pinfixing protrusions having holes therein for receiving pin 24. Thus said right and left tube members 21, 22 are able to be pivotably and integrally hinged together in assembly by means of a pair of pins 24. Moreover, a C-shaped component 25 is adapted to mount on the said rectangular block 23.

Figure 7:
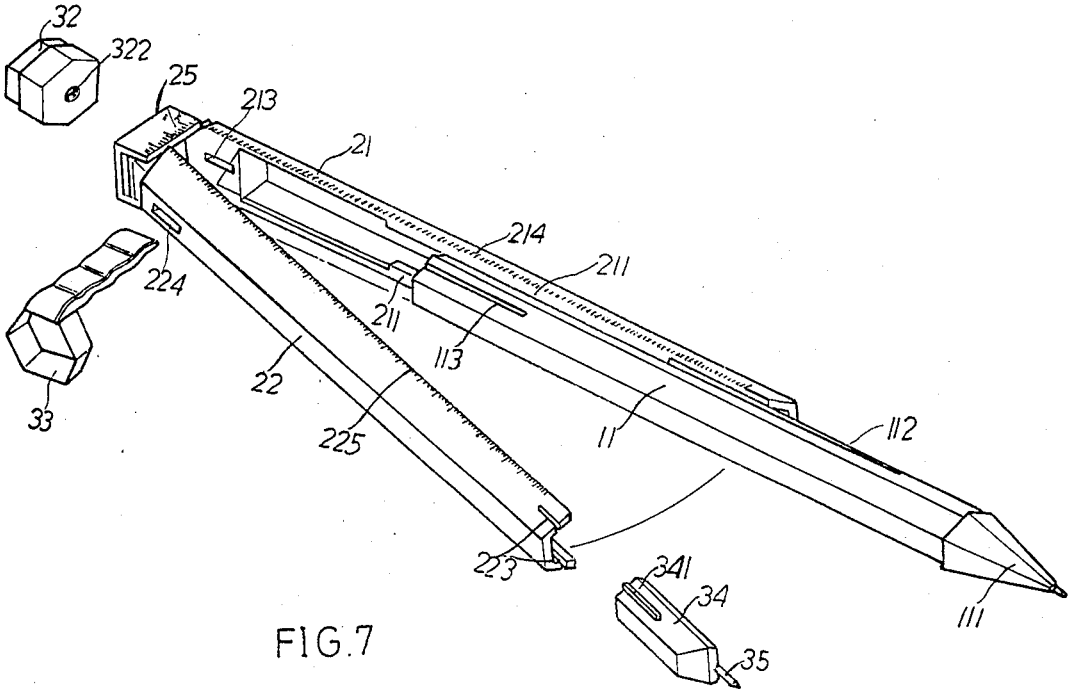
FIG. 7 is a diagram showing the present invention being converted to a compass.

When said core member 11 is pulled out, said short flutes 113 will first be free from registry with the projections 221 of the said left tube member 22 so that said left tube member can be pivotally moved outwardly as shown in FIG. 7, serving as a leg of a compass when a needle mount 34 is attached at the front end thereof. Mount 34 has a needle 35 and a flange 341 for fixing purposes, as shown in FIG. 8.

A receiving case 31 having a hexagonal cross section is used to accommodate said needle mount 34 which is attached with a cylindrical eraser 37 at the end and a needle at the front. A clip means 33 is removably secured to the outside of said receiving case 31, and can be taken off therefrom and inserted into two rectangular openings 213, 224 disposed at the end of said right and left tube members, thus the right and left tube members can be tightly and adjustably associated with each other when used as a compass.

Figure 8:
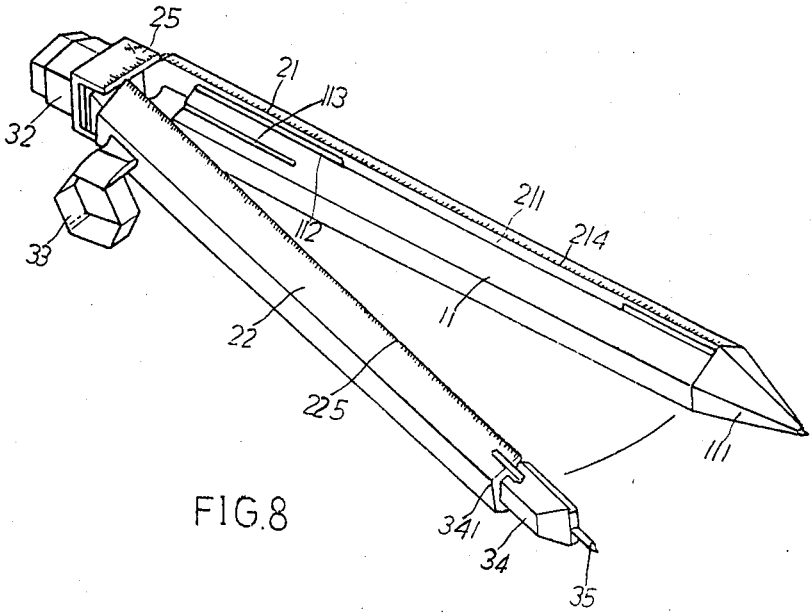
FIG. 8 is a diagram showing an assembled compass according to the present invention.

A pair of symmetric elongated protrusions 341 are disposed on the said needle mount 34 and can be in registry with a pair of correspondingly disposed slots 223 at the front end of said left tube member 22 so to fix said needle mount 34 in place when the writing instrument of the present invention is converted into a compass, as shown in FIG. 8.

On the external top surface of said C-shaped connecting component 25, a projecting screw 252 is disposed so that a hexagon-shaped cap 32 is able to be attached thereon for facility of holding the device when used as a compass. On the top surface 321 of said cap 32 a screw hole 322 is disposed for effecting the above-said attachment. Said clip means 33 is structured in a wavy form so that it can provide better friction effects against the surfaces of said right and left tube members when operated as a compass.

Figure 9:
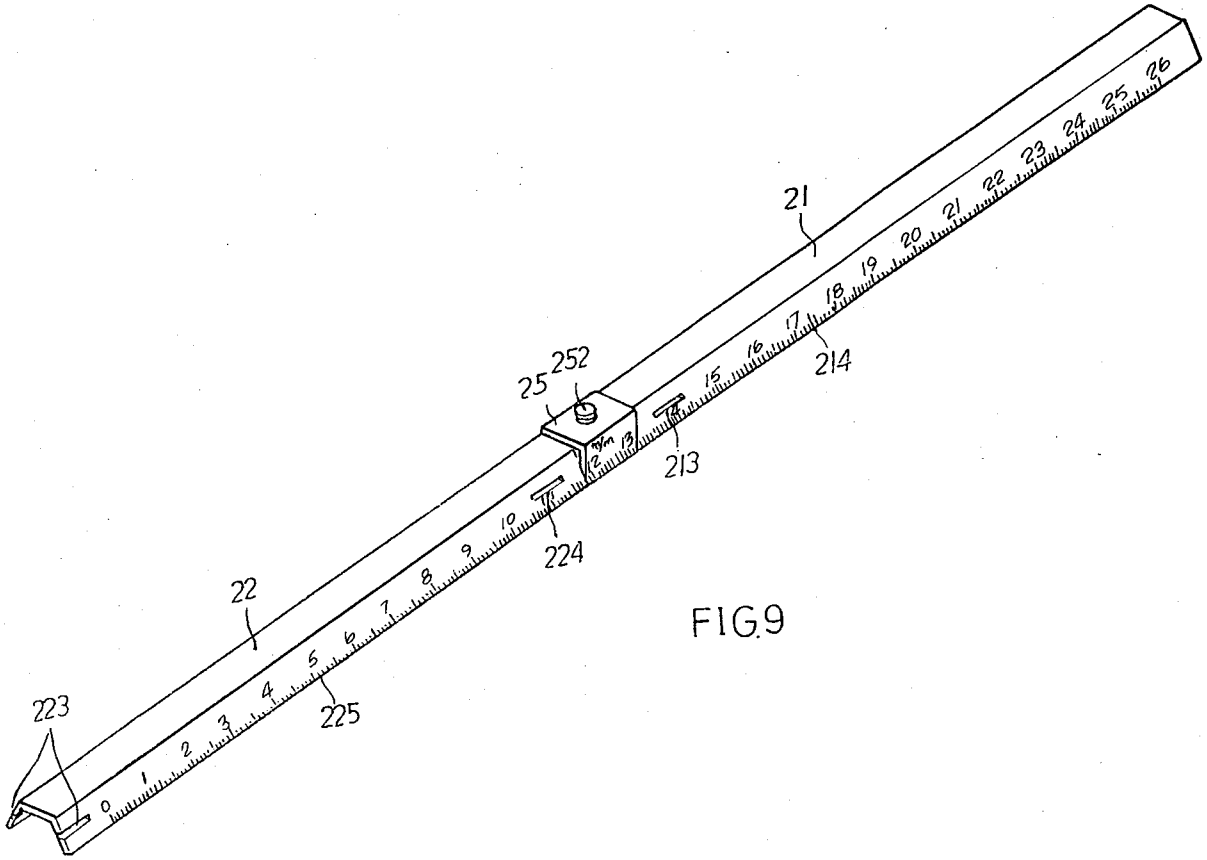
FIG. 9 is a diagram showing the present invention being used as a straight ruler.

As shown in FIG. 9, when said core member 11 and said needle mount 34 are removed, said right and left tube members are able to be widely opened to the extent of being arranged in a straight line thereby a straight ruler can be constituted. On the surfaces 214, 215, 225, 226 of said right and left tube members 21, 22, measurement marks in centimeters and inches are set. Moreover said C-shaped component 25 is also provided with similar measurement marks so that the straight ruler can be continously and completely marked as a whole. Said core member 11 with said ball-pen tube 12 is able to be independently used as a marking tool.

Said receiving case 31 having a hexagon cross section is provided with a pair of lugs 311 symmetrically located on the inner walls of the right side portion thereof for preventing said needle mount 34 from detaching from said receiving case 31 at the other open end. Said needle mount 34 has two tapered front sides, different in their beveled levels and resulting in an eccentric front tip edge thereof, thus the front end of said core member 11 can be received within said receivng case together with said needle mount 34 side by side without interference. At the end of said needle mount 34, a circular hole 343 is disposed for the location of a cylinder-shaped eraser 37 which is partially surrounded by a piece of sealing element 36 for stopping said eraser 37 from getting detached from said hole 343. Moreover, said hexagon-shaped cap 32 is removably fixed to one end of said receiving case along with a clip member 33 having a wavy structure as preceedingly described attached thereto for ready carrying.

I claim:

1. A multi-purpose combination writing instrument adapted to be selectively used as a writing implement, a compass and a ruler comprising:

a removable core member having a plurality of flutes formed therein;

a tube having two separable right and left members pivotably hinged together at one end, each tube member comprising protrusions on facets thereof adapted to engage the flutes of said core member for movably fixing said core member in said tube;

a receiving case adapted to be used as a cap for the writing implement;

a needle mount adapted to receive a needle and an eraser removably disposed within said receiving case; and a clip member being removably attached to the outside of said receiving case.

2. A multi-purpose combination writing instrument as set forth in claim 1, wherein said core member is structured to have a tapered six-facet front portion with a hexagon cross section, and the remainder of said core member is uniform hexagon shape with a ball-pen tube removably housed therein; a lid component is adapted to be screwed at the end of said core member for stopping said ball-pen tube from detaching from said core member; and said plurality of flutes comprise a pair of elongated flutes and a pair of relatively short flutes symmetrically disposed respectively on the facets of said core member.

3. A multi-purpose combination writing instrument as set forth in claim 2, wherein said right and left tube members are structured to have a cross section of half hexagon shape so that said core member can be housed in the space formed by the assembled right and left tube members; said protrusions comprise two oppositely located elongated protrusions disposed on the inner wall of said right tube member, and two relatively short projections disposed on the inner wall of said left tube member; a pair of symmetrically disposed slots are provided at the front end of said left tube member; a pin hole is located at the rear end of each of said tube members; a rectangular block with four pinfixing protrusions is provided for assembly in association with both said right and left tube members; and the outer surfaces of both said right and left tube members are provided with measuring marks.

4. A multi-purpose combination writing instrument as set forth in claim 3, wherein said rectangular block with four pin-fixing protrusions symmetrically disposed on one side thereof is adapted to pivotably join said right and left tube members together so that the writing instrument is convertible into a compass and into an elongated straight ruler with measuring marks thereon when the right and left tube members are opened so that the tube members extend at an angle of 180 degrees with respect to one another.

5. A multi-purpose combination writing instrument as set forth in claim 4, wherein said rectangular block is attached to said tube members with a C-shaped connecting component thereon which bridges the gap between said right and left tube members when the same are arranged rectilinearly, and a protruded screw is provided on the outer surface of said C-shaped connecting component.

6. A multi-purpose combination writing instrument as set forth in claim 5, wherein said receiving case used as a cap is of hexagon configuration and is detachably mounted to the front end of said writing instrument, a pair of lugs are disposed in the interior of said receiving case for effecting restraint of said needle mount; the needle mount is housed in said receiving case, and the clip member and a hexagonal cap are in movable association with one end of said receiving case.

7. A multi-purpose combination writing instrument as set forth in claim 6, wherein said needle mount has a hexagonal shape with an eccentrically tapered front end and an elongated bore in which said needle is inserted; a cylindrical hole is disposed at the other end of said needle mount for receiving a cylindrical eraser; and a pair on the outer surface of said needle mount, of symmetric longitudinal protrusions are provided for engagement with a pair of corresponding slots disposed on the front end of said left tube member so that said needle mount can be mounted thereon when said writing instrument is converted into a compass.

8. A multi-purpose combination writing instrument as set forth in claim 7, wherein said hexagonal cap is provided with a hole on the top surface thereof which is in engagement with said projecting screw on the top surface of said C-shaped connecting component with said clip member being insertedly attached to rectangular openings disposed at both the rear ends of said right and left tube members, and said needle mount is removably fixed to the end of said left tube member so that the writing instrument can be converted into a compass.

9. A multi-purpose combination writing instrument as set forth in claim 8, wherein said clip member has a hexagonal opening for slidably attaching the same to the hexagonal receiving case, and an elongated portion having wavy structure.

* * * * *